US011427965B2

(12) United States Patent
Hietaniemi et al.

(10) Patent No.: US 11,427,965 B2
(45) Date of Patent: Aug. 30, 2022

(54) DRY STRENGTH COMPOSITION, ITS USE AND METHOD FOR MAKING OF PAPER, BOARD OR THE LIKE

(71) Applicant: Kemira Oyj, Helsinki (FI)

(72) Inventors: Matti Hietaniemi, Espoo (FI); Asko Karppi, Turku (FI); Jonas Konn, Espoo (FI)

(73) Assignee: Kemira Oyj, Helsinki (FI)

( * ) Notice: Subject to any disclaimer, the term of this patent is extended or adjusted under 35 U.S.C. 154(b) by 34 days.

(21) Appl. No.: 16/969,992

(22) PCT Filed: Jan. 18, 2019

(86) PCT No.: PCT/FI2019/050036
§ 371 (c)(1),
(2) Date: Aug. 14, 2020

(87) PCT Pub. No.: WO2019/180302
PCT Pub. Date: Sep. 26, 2019

(65) Prior Publication Data

US 2021/0102343 A1 Apr. 8, 2021

(30) Foreign Application Priority Data

Mar. 22, 2018 (FI) ..... 20185272

(51) Int. Cl.

| | |
|---|---|
| ***D21H 21/20*** | (2006.01) |
| ***D21F 11/00*** | (2006.01) |
| ***D21H 17/00*** | (2006.01) |
| ***D21H 17/29*** | (2006.01) |
| ***D21H 23/04*** | (2006.01) |

(52) U.S. Cl.
CPC ..... *D21H 21/20* (2013.01); *D21F 11/00* (2013.01); *D21H 3/00* (2013.01); *D21H 17/29* (2013.01); *D21H 23/04* (2013.01)

(58) Field of Classification Search
CPC ..... D21H 17/25; D21H 17/28; D21H 3/00; D21H 17/24; D21H 17/26; D21H 23/04; D21H 21/18; D21H 17/29; D21H 11/18; D21H 21/20; D21H 11/00
USPC ..... 162/175
See application file for complete search history.

(56) References Cited

U.S. PATENT DOCUMENTS

| | | | |
|---|---|---|---|
| 4,710,270 A | 12/1987 | Sunden et al. | |
| 5,061,346 A | 10/1991 | Taggart et al. | |
| 5,104,487 A | 4/1992 | Taggart et al. | |
| 5,129,989 A | 7/1992 | Gosset et al. | |
| 6,413,372 B1 | 7/2002 | Maliczyszyn et al. | |
| 6,616,807 B1 | 9/2003 | Dyllick-Brenzinger et al. | |
| 2004/0237839 A1 | 12/2004 | Glittenberg et al. | |
| 2011/0200721 A1* | 8/2011 | Funda | A23L 19/09 426/289 |
| 2013/0052108 A1 | 2/2013 | Ifrah et al. | |
| 2013/0180680 A1 | 7/2013 | Axrup | |
| 2017/0268176 A1 | 9/2017 | Hietaniemi et al. | |

FOREIGN PATENT DOCUMENTS

| | | | |
|---|---|---|---|
| CN | 103547734 | | 1/2014 |
| EP | 1918455 | A1 | 5/2008 |
| RU | 2518969 | C2 | 6/2014 |
| WO | 9704168 | A1 | 2/1997 |
| WO | 9964677 | A1 | 12/1999 |
| WO | 03087473 | A1 | 10/2003 |
| WO | 2006050848 | A1 | 5/2006 |
| WO | 2007103024 | A1 | 9/2007 |
| WO | 2012042115 | A1 | 4/2012 |
| WO | 2012168204 | A1 | 12/2012 |
| WO | 2014029916 | A1 | 2/2014 |
| WO | 2015036930 | A1 | 3/2015 |
| WO | 2016034776 | A | 3/2016 |
| WO | 2017149200 | A1 | 9/2017 |

OTHER PUBLICATIONS

Hollertz, R. et al. Chemically modified cellulose micro- and nanofibrils as paper-strength additives. In: Cellulose, Jun. 29, 2017, pp. 3883-3899, [retrieved on Jul. 5, 2018], <DOI: 10.1007/s10570-017-1387-6> Whole document.

Handbook of Starch Hydrolysis Products and their Derivatives, Edited by Kearsley, M et al. Springer Science & Business Media, Dec. 6, 2012, p. 12, ISBN 1461521599, 9781461521594. p. 12.

Search report for CN application 2019800209179, dated on Mar. 2, 2022, 4 pages.

Search report for RU applicaiton 2020130338, dated Mar. 10, 2022, 3 pages.

* cited by examiner

*Primary Examiner* — Mark Halpern
(74) *Attorney, Agent, or Firm* — Meunier Carlin & Curfman LLC

(57) ABSTRACT

A dry strength composition for manufacture of paper, board or the like is disclosed. The dry strength composition includes, as a mixture, at least one anionically derivatized polysaccharide, and cationic starch having an amylopectin content ≥80 weight-%. The anionically derivatized polysaccharide and the cationic starch provide the composition with a charge density in a range of 0.1-1.5 meq/g, when measured at pH 2.8, and −0.1-−3 meq/g, preferably −0.3-−2.5 meq/g, more preferably −0.5-−2.0 meq/g, when measured as an aqueous solution, at pH 7.0. Further disclosed are a use of the composition and a method for manufacturing paper, board or the like.

6 Claims, No Drawings

DRY STRENGTH COMPOSITION, ITS USE AND METHOD FOR MAKING OF PAPER, BOARD OR THE LIKE

PRIORITY

This application is a U.S. national application of the international application number PCT/FI2019/050036 filed on Jan. 18, 2019 and claiming priority of FI application number 20185272 filed on Mar. 22, 2018, the contents of all of which are incorporated herein by reference.

The present invention relates to a dry strength composition and its use, as well as to a method for making of paper, board or the like according to the preambles of the enclosed independent claims.

In manufacture of paper or board the properties of the fibre stock as well as the final paper are modified by adding various chemicals to the fibre stock before the formation of the paper or board web. Many of the used chemicals are synthetic polymers, which are manufactured from monomers originating from petroleum based raw materials. In view of the ecological impact of the polymer manufacture and the on-going discussion of the possible harmful environmental effects of the extensive polymer usage, there is need for alternative solutions. There is a growing desire to reduce the use of fully synthetic chemicals also in paper and board making and to further improve the environmental aspects and sustainability of cellulosic products by using chemicals and additives based on natural substances, which preferably are even biodegradable.

A property, often desired for the final paper or board, is the dry strength. Synthetic polymers, either anionic or cationic, are commonly used in papermaking to increase, for example, the dry strength properties of the final paper or board. These polymers are added to the fibre stock where they interact with the components of the stock, e.g. fibres and/or fillers. The conventional ways to increase the dry strength properties of paper have, however, their drawbacks. As discussed above, synthetic polymers do not necessarily fulfil the sustainability requirements. Furthermore, the conventional strength agents are not optimal when making of paper or board with high filler content. For example, it has been observed that synthetic polymers have their limitations when they are used as dry strength agents. Anionic polymers are often added together with a cationic additive. As the fibre surface is also anionic, the cationic additive is consumed both by fibre surfaces and by the anionic polymer. The problem becomes more pronounced if the pulp contains high amounts of anionic trash, i.e. has high cationic demand. For practical reasons, such as overall process economy, the dosage of cationic additive to the fibre stock cannot be added ad infinitum. As the dosage of the cationic additive has practical limitations, also the dosage of the anionic polymer is thus in practice limited to a level, which does not necessarily provide a sufficient increase in dry strength properties. Any further increase in dosage of the anionic polymer would only increase anionic content in circulating process waters and possibly lead other process problems due to excess anionic charges. From environmental point of view, the increase of anionic polymer is not considered as a recommendable option.

Anionic strength additives, such as carboxymethyl cellulose or low molecular weight anionic polyacrylamides, which are commonly used in paper and board making, often lead to a decrease in the drainage, especially at higher dosages. This increases the drying demand of the paper or board and consequently, steam consumption in the dryer section. Drying capacity is most often a limiting factor in the paper and board production, and the drying demand of the paper often restricts the productivity rates.

A further significant challenge for conventional dry strength systems comprising cationic and anionic polymers is the conductivity of the fibre stock. When the conductivity of the fibre stock is high, the ionic bonds to be formed between the polymer components are disturbed and replaced by salt formation. High conductivity of the fibre stock may also cause shrinking and compression of the three-dimensional structure of polymer and change the polymer performance. Paper and board making processes which are operated with low fresh water consumption, i.e. closed water circulations, often have high conductivity.

There is a constant need to find new effective substances or compositions, which could provide a sustainable and biodegradable option for synthetic polymers, and that could be used to increase the dry strength properties of the produced paper and board. Further, there is continuing desire to increase the amount of fillers in the stock, as well as a desire to use recycled fibres and/or high freeness or high bulk pulp, such as CTMP, with low strength characteristics, especially low z-directional tensile strength. The new compositions should also be cost effective, easy to transport and store. Drainage and dewatering of the formed fibre web in the successive process steps after web formation, e.g. press section, should also be non-hindered.

An object of this invention is to minimise or even eliminate the disadvantages existing in the prior art.

An object is a dry strength composition and a method which provide a sustainable and biodegradable alternative for increasing the dry strength properties of the final paper or board.

An object is a dry strength composition and a method which provide effective increase in dry strength properties of the final paper or board.

A further object of this invention is a dry strength composition and a method which are also suitable for fibre stocks having a high cationic demand.

A yet further object of this invention is a dry strength composition and a method which are also suitable for fibre stocks having a high conductivity.

These objects are attained with the invention having the characteristics presented below in the characterising parts of the independent claims. Some preferable embodiments are disclosed in the dependent claims.

The embodiments mentioned in this text relate, where applicable, to all aspects of the invention, even if this is not always separately mentioned.

Typical dry strength composition according to the present invention for manufacture of paper, board or the like, comprises, as a mixture, at least one anionically derivatized polysaccharide, and cationic starch having an amylopectin content 80 weight-%, wherein the anionically derivatized polysaccharide and the cationic starch provide the composition with a charge density in the range of −0.1-1.5 meq/g, when measured at pH 2.8, and −0.1--3 meq/g, preferably −0.3--2.5 meq/g, more preferably −0.5--2.0 meq/g, when measured as an aqueous solution, at pH 7.0.

Typical use of a dry strength composition according to the present invention is for improving strength properties of a paper, board or the like.

Typical method according to present invention for manufacturing of paper, board or the like comprises obtaining a fibre stock comprising cellulosic fibres, adding a cationic coagulant and/or cationic strength agent to the fibre stock, and introducing to the fibre stock a dry strength composition comprising at least one anionically derivatized polysaccharide, and cationic starch having an amylopectin content 80 weight-%, wherein anionically derivatized polysaccharide and cationic starch provide the composition with a charge density in the range of −0.1-1.5 meq/g, when measured at pH 2.8, and −0.1--3 meq/g, preferably −0.3--2.5 meq/g, more preferably −0.5--2.0 meq/g, when measured as an aqueous solution, at pH 7.0, and optionally, introducing a retention aid to the fibre stock.

Now it has been surprisingly found out that an effective increase in dry strength properties is achieved when using a dry strength composition comprising at least one anionically derivatized polysaccharide and cationic starch having high amylopectin content. Without wishing to be bound by a theory, it is assumed that the cationic starch provides a long-reaching three-dimensional network which may interact with the fibres and filler particles in the fibre stock. In particular the cationic starch may be considered to act like a "carrier" or "polyionic cross-linker" for the anionically derivatized polysaccharide. The interaction of the cationic starch and the anionically derivatized polysaccharide results in a structure that could be seen as polyionic complex. The dry strength composition according to the present invention is able to create different kinds of bonds with the fibre stock components: cationic starch forms in particular hydrogen bonds, and the anionically derivatized polysaccharide forms in particular ionic bonds as well as hydrogen bonds. The different bonds complement each other and provide a good dry strength effect in various environments. It has been observed that the dry strength composition, which comprises at least one anionically derivatized polysaccharide and the cationic starch, is able to provide sufficient contribution to the dry strength of the final product, and there is no need to use synthetic polymers obtained by polymerisation of monomers. This makes it possible to use only components of biological origin in the dry strength composition, which may provide advantages in biodegradability and sustainability of the produced final products. Also, the risk for hazardous monomer residues or the like is avoided.

Conventionally it would be expected that an addition of anionically derivatized polysaccharide might lead to negative effects in drainage. Surprisingly, it may be possible to avoid drainage decreasing effect of the anionically derivatized polysaccharide when the dry strength composition of the present invention is used. It is presumed that this may be due to the presence of the cationic starch in the composition.

Furthermore, it has been observed that the present invention unexpectedly enhances the retention of the anionically derivatized polysaccharide and its contribution to the dry strength of the final fibre product. It is currently speculated that the anionically derivatized polysaccharide shows improved retention to the fibre web due to the three-dimensional network provided by the cationic starch included in the dry strength composition. The present invention may also improve the total retention of solid matter, e.g. fillers and/or fines, and/or retention of other constituents present in the fibre stock, e.g. dissolved and/or colloidal material, polymers and/or sizing agents. In general, improved retention usually improves the quality of the circulating process waters, e.g. by reducing the cationic demand of the water.

In the context of the present application the term "aqueous solution" encompasses not only true solutions, but also aqueous dispersions as well as solutions that may contain minor amounts of incompletely dissolved or partially dissolved material, or undissolved or incompletely dissolved residues. The general definition applies to the aqueous solutions of dry strength composition as well as to its individual components, i.e. aqueous solutions of anionically derivatized polysaccharides and aqueous solutions of cationic starch, if not otherwise indicated. Preferably the aqueous solutions contain less than 5 weight-%, preferably less than 2 weight-%, more preferably less than 1 weight-%, of insoluble material or they are free from insoluble material.

The dry strength composition according to the present invention thus comprises both anionic groups mainly originating from the anionically derivatized polysaccharide as well as cationic groups mainly originating from the cationic starch. It has been found that the net charge of the dry strength composition provides optimal behaviour at different pH values encountered during preparation, storage and/or transport of the composition as well as usage of the dry strength composition. According to one embodiment of the invention the anionically derivatized polysaccharide and the cationic starch provide the dry strength composition with a charge density in the range of −0.1--3 meq/g, preferably −0.3--2.5 meq/g, more preferably −0.5--2.0 meq/g or −0.5--2.5 meq/g, when measured at pH 7.0. In practice this means that the dry strength composition has anionic net charge at normal fibre stock pH. The defined charge density is sufficient to ensure the presence of anionic charges in order to provide an effective interaction both with cationic strength agent as well as the fibres and fillers in the stock and to obtain optimal strength effect.

Polysaccharides, as known, are natural polymers formed from polymeric carbohydrate molecules, which comprise long chains of monosaccharide units as repeating units bound together by covalent bonds. Polysaccharides may be extracted from various botanical sources, microorganisms, etc. Polysaccharide chains contain multiple hydroxyl groups capable of hydrogen bonding.

In the present context the term "anionically derivatized" is understood to refer not only to chemical modification of a polysaccharide by reactions which result in covalently bonded anionic groups in the polysaccharide structure, but also to any sufficient association of anionic groups with the polysaccharide structure, which provide the desired properties, such as charge density, for the dry strength composition. Such sufficient association of anionic groups may be achieved, for example, by adsorption or by other processing of the polysaccharide starting material, such as mechanical processing. It is possible to obtain anionically derivatized polysaccharide by combination of other processing, such as mechanical processing, and chemical modification. Chemical modification of the polysaccharide is preferred for providing anionically derivatized polysaccharide suitable for use in the present invention. Anionic groups may be provided e.g. by incorporating to the polysaccharide structure carboxyl, sulphate, sulphonate, phosphonate or phosphate groups, including their salt forms, or combinations thereof. Anionic groups may be introduced to the polysaccharide structure by suitable chemical modification including carboxymethylation, oxidation, sulphation, sulphonation and phosphorylation.

According to one embodiment of the invention the anionically derivatized polysaccharide which is suitable for use in the present invention may have a charge density value in the range of −0.15--5.0 meq/g, such as −0.3--5.0 meq/g or −0.5--5.0 meq/g, preferably −0.7--4.5 meq/g, more preferably −1.0--4.0 meq/g, measured at pH 7. Measured charge density values are calculated per weight as dry and measured as described in the experimental section.

The anionically derivatized polysaccharide may comprise water-soluble and/or water-dispersible anionically derivatized polysaccharide(s). In the present context aqueous solution of anionically derivatized polysaccharide covers not only true solutions but also aqueous dispersions of anionically derivatized polysaccharide(s). Preferably the anionically derivatized polysaccharides are water-soluble, meaning that they contain at most 30 weight-%, preferably at most 20 weight-%, more preferably at most 15 weight-%, even more preferably at most 10 weight-%, of water-insoluble material. The water-solubility may improve the availability of the functional groups of the polysaccharide, thereby improving the interaction with the cationic starch of the dry strength composition, as well as the other constituents present in the fibre stock.

According to one embodiment of the invention anionically derivatized polysaccharide comprises anionically derivatized celluloses, anionically derivatized starches, or any combinations thereof, including modified celluloses and starches, such as hydroxyethyl cellulose, hydroxyethyl starch, ethylhydroxyethyl cellulose, ethylhydroxyethyl starch, hydroxypropyl cellulose, hydroxypropyl starch, hydroxypropyl hydroxyethyl cellulose, hydroxypropyl hydroxyethyl starch, methyl cellulose, methyl starch, and the like.

According to one preferable embodiment the anionically derivatized polysaccharide comprises cellulose, preferably carboxymethylated cellulose, even more preferably carboxymethyl cellulose. Anionically derivatized polysaccharide may comprise, for example, purified carboxymethyl cellulose or technical grade carboxymethyl cellulose. The carboxymethyl cellulose may be manufactured by any process known in the art. It is believed that when the dry strength composition comprises anionically derivatized polysaccharide, which comprises cellulose, the backbone structure of the polysaccharide is similar than the cellulosic fibres in the pulp, i.e. the structure showing 1,4-beta glycosidic linkages in the backbone. This matching configuration may provide stronger interaction between the dry strength composition and the fibres.

According to one embodiment of the invention the anionically derivatized polysaccharide comprises carboxymethylated cellulose, preferably carboxymethyl cellulose, which may have a degree of carboxymethyl substitution >0.2, preferably in the range of 0.3-1.2, more preferably 0.4-1.0 or 0.5-1.0, providing further enhanced water-solubility. In one preferable embodiment the carboxymethylated cellulose may have a degree of carboxymethyl substitution in the range of 0.5-0.9, which provides essentially complete water-solubility for the carboxymethyl cellulose.

According to one embodiment of the invention the anionically derivatized polysaccharide comprises carboxymethylated cellulose, preferably carboxymethyl cellulose, which may have a charge density value <−1.1 meq/g, preferably in the range of −1.6--4.7 meq/g, more preferably −2.1--4.1 meq/g, even more preferably −2.5--3.8 meq/g, when measured at pH 7. All measured charge density values are calculated per weight as dry.

According to one embodiment of the invention the anionically derivatized polysaccharide comprises carboxymethylated cellulose, preferably carboxymethyl cellulose, which may have viscosity in the range of 100-30 000 mPas, preferably 200-20 000 mPas, more preferably 500-10 000 mPas, measured from 2 weight-% aqueous solution at 25° C., by using Brookfield LV DV1, as defined in the experimental section.

According to one embodiment of the invention the anionically derivatized polysaccharide comprises carboxymethylated cellulose, preferably carboxymethyl cellulose, which may have ash content <35 weight-% of dry material, preferably <30 weight-%, more preferably <25 weight-%, as measured at 525° C., 4 h. It is assumed that a low ash content facilitates the formation of the polyion complex between the cationic starch and the anionically derivatized polysaccharide.

According to one embodiment the anionically derivatized polysaccharide may be at least partly in microfibrillar form. Preferably the anionically derivatized polysaccharide comprises anionic microfibrillar cellulose. Microfibrillar cellulose is sometimes referred to as nanocellulose, but as used herein, by microfibrillar cellulose or nanocellulose it is not meant crystalline cellulose derivatives known e.g. as microcrystalline cellulose (MCC), nanocrystalline cellulose (NCC), or cellulose nanowhiskers. Crystalline cellulose derivatives are thus excluded from anionic microfibrillar cellulose. Microfibrils may have an average diameter of 2-60 nm, preferably 4-50 nm, more preferably 5-40 nm, and an average length of several micrometers, preferably less than 500 μm, more preferably less than 300 μm, more preferably 2-200 μm, even more preferably 10-100 μm, most preferably 10-60 μm. Microfibrillated cellulose comprises often bundles of 10-50 microfibrils.

According to one embodiment the anionically derivatized polysaccharide is free from microfibrillar cellulose.

The dry strength composition comprises cationic starch, which of natural origin and has an amylopectin content at least 80 weight-%. Amylopectin is a branched starch molecule, where branching typically occurs with $\alpha(1\rightarrow6)$ bonds about at every 15-30 anhydroglucose units of the starch backbone, which contains $\alpha(1\rightarrow4)$ bonds. Amylopectin content of the cationic starch ensures that that the size of the polyion complex to be formed has appropriate dimensions, required for good strength characteristics. Large size and abundance of ionic groups in the polyionic complex improve the retention of the complex to the fibre web, especially in comparison to the conventional anionic strength additives.

According to one preferable embodiment the cationic starch of the dry strength composition may have an amylopectin content 85 weight-%, preferably 90 weight-%, more preferably 95 weight-%. Cationic starch of the dry strength composition may originate from potato, waxy potato, rice, waxy corn, sweet potato, arrowroot or tapioca starch, or any combination thereof. Preferably the cationic starch originates from waxy corn starch and/or waxy potato starch.

The cationic starch may comprise starch units, i.e. starch molecules, of which at least 70 weight-%, preferably at least 80 weight-%, more preferably at least 85 weight-%, even more preferably at least 90 weight-%, sometimes even more preferably at least 95 weight-%, have an average molecular weight MW over 20 000 000 g/mol, preferably over 50 000 000 g/mol, more preferably over 100 000 000 g/mol, sometimes even over 200 000 000 g/mol.

According to one embodiment of the invention the dry strength composition comprises cationic starch, which comprises cationic non-degraded starch. The cationic non-degraded starch provides an optimal interaction with the anionically derivatized polysaccharide as well as with other constituents of the fibre stock, e.g. fibres and/or inorganic fillers. The polyion complex to be formed may have enhanced dimensions, and guarantee a good interaction with cationic additives, such as cationic strength agent, which are separately added to the fibre stock. In the present context, the term "non-degraded starch" denotes starch which is essentially untreated by oxidative, thermal, enzymatical and/or acid treatment in a manner that would cause hydrolysis of glycosidic bonds or degradation of starch molecules or units. In case the starch is solubilized by cooking, the temperature during cooking is less than 140° C., preferably less than 120° C., often less than 110° C. or 105° C.

For example, after solubilization the non-degraded cationic starch has a viscosity at least of 20% preferably at least 50% of a viscosity of a corresponding native starch, solubilized by cooking at 97° C. for 30 min. The viscosity measurement is made by Brookfield LV-DVI viscometer, at 2% solids content and at room temperature.

Cationic starch suitable for use in the dry strength composition may be obtained by cationising starch by any suitable method. Preferably cationic starch is obtained by using 3-chloro-2-hydroxypropyltrimethylammonium chloride or 2,3-epoxypropyltrimethylammonium chloride. It is also possible to cationise starch by using cationic acrylamide derivatives, such as (3-acrylamidopropyl)-trimethylammonium chloride. Various methods for cationisation of starch are known for a person skilled in the art.

According to one embodiment the cationic starch has been obtained by using cationisation as the sole chemical derivatization of starch, and the cationic starch is thus non-cross-linked, non-grafted, or it has not been otherwise chemically modified.

The cationic starch of the dry strength composition may have a substitution degree of 0.025-0.3, preferably 0.03-0.16, more preferably 0.045-0.1. The substitution degree is relative to the cationicity of the starch, the higher substitution degree indicating a higher cationicity. Cationic starches having relatively high substitution degree, and cationicity, are preferred for use in the dry strength composition as they may provide additional benefits. For example, use of such starches in the dry strength composition may further improve the dry strength effect, which is observed in the final paper or board.

According to one preferable embodiment the dry strength composition is free of cationic synthetic polymers, especially cationic synthetic strength polymers.

According to one embodiment the dry strength composition, the cationic starch and/or the anionically derivatized polysaccharide may comprise further auxiliaries or additives, such as preservatives, biocides, stabilizers, antioxidants, pH adjusting agents or the like.

According to one preferable embodiment of the invention the dry strength composition comprises anionically derivatized polysaccharide and cationic starch in weight ratio (dry/dry) 10:90-90:10, preferably 30:70-70:30, more preferably 40:60-60:40. The weight ratio is given as dry weights. Preferably the weight ratio of the anionically derivatized polysaccharide to the cationic starch is chosen so that the dry strength composition is net anionic at the pH of the fibre stock.

The dry strength composition comprises a mixture of anionically derivatized polysaccharide and cationic starch. The anionically derivatized polysaccharide and cationic starch may be mixed with each other before the addition of the composition as an aqueous solution to the fibre stock, i.e. before the addition as a single solution. The mixing may be performed in any suitable way of combining the anionically derivatized polysaccharide and cationic starch. For example, it is possible to mix the anionically derivatized polysaccharide and the cationic starch in dry form or as aqueous solutions, or the anionically derivatized polysaccharide or the cationic starch in dry form may be dissolved to an aqueous solution of the other component.

According to one preferable embodiment the dry strength composition is in form of an aqueous solution, and it is introduced to the fibre stock as an aqueous mixture, which comprises at least one anionically derivatized polysaccharide and cationic starch. The term "aqueous solution" encompasses here not only true solutions but also aqueous dispersions. Preferably, the dry strength composition in form of an aqueous solution contains at most minor amounts of incompletely dissolved residue, or is completely free of solid matter and/or incompletely dissolved residues.

Alternatively, the dry strength composition may be in form of a dry particulate material. This reduces the risk of degradation of the dry strength composition during transportation and storage, and thus improves the shelf life. Especially the cationic starch may be vulnerable to microbiological degradation, which could lead to loss of performance. The dry strength composition may preferably be a mixture of solid particulate anionically derivatized polysaccharide and solid particulate cationic starch. Such mixture in particulate form is easy and economically advantageous to store and transport. The dry strength composition in form of a dry particulate material may have a moisture content of at most 25 weight-%. The particle size of the dry particulate material may vary for example between 5 and 2000 microns.

When the dry strength composition is in form of dry particulate material, it can be dissolved into water in order to obtain an aqueous dry strength composition, for example, by using effective high-shear dissolution, such as rotor-stator mixer, and optional application of heat, or by using jet-cooker. The dissolving may be done e.g. at the site of application, such as on-site at a papermill. According to one preferred embodiment of the invention the dry strength composition in form of a dry particulate material is dissolved into water, preferably by using a high-shear dissolution, in order to obtain an aqueous dry strength composition. The obtained aqueous dry strength composition may then be optionally diluted and then introduced, after the optional dilution, to the fibre stock at selected application location.

According to one embodiment the anionically derivatized polysaccharide and cationic starch of the dry strength composition may be mixed on-site at the paper or board mill. This means that the anionically derivatized polysaccharide and cationic starch may be transported separately, for example as dry products, to the site of use, such as paper mill or board mill. At the site of use the anionically derivatized polysaccharide and cationic starch may be optionally dissolved and/or diluted and prepared into the aqueous dry strength composition by mixing. The anionically derivatized polysaccharide and cationic starch agent can be dissolved into water separately, whereby an aqueous solution of anionically derivatized polysaccharide as well as an aqueous solution of cationic starch are obtained. The anionically derivatized polysaccharide is usually easily dissolved or dispersed in water by simple mixing, even in cold water, e.g. 10-30° C. The cationic starch may be dissolved in water, e.g. by cooking. The cooking may be performed at temperature of 60-150° C. When higher temperatures are used, the cooking time is kept sufficiently short to minimise undesired degradation of the starch. Typical cooking time at 110-150°

C. is about 1-2 min. When relating to the cationic starch the term "aqueous solution" encompasses here not only true solutions but also containing minor amounts of incompletely dissolved residues.

In embodiments where the anionically derivatized polysaccharide and cationic starch are separately dissolved, they may be mixed together as aqueous solutions to form the dry strength composition, whereby the dry strength composition is introduced to the fibre stock as aqueous mixture, optionally after further dilution.

According to another embodiment of the invention the dry strength composition is introduced to the fibre stock through a single inlet to which separate aqueous solutions of at least one anionically derivatized polysaccharide and cationic starch are fed. For example, the anionically derivatized polysaccharide and cationic starch may be fed to a pipeline leading to the single inlet, whereby the cationic starch and anionically derivatized polysaccharide are at least partially mixed already in the pipeline before the inlet. Alternatively, anionically derivatized polysaccharide and cationic starch may be fed two pipelines leading to the single inlet, whereby they are mixed together at the moment they are introduced to the fibre stock. Yet alternatively, the dry strength composition may be introduced to the fibre stock by adding separate aqueous solutions of at least one anionically derivatized polysaccharide and cationic starch to the fibre stock separately but simultaneously, i.e. within at most 2 seconds interval between their addition. This may be conducted e.g. by using known intensive mixing devices, such as Trumpjet® (Wetend Technologies Ltd). These embodiments are advantageous as no additional storage tanks or mixing vessels are necessary for storing and mixing the individual components of the dry strength composition. Furthermore, the time for interaction between the individual components and the formation of the polyionic complex may be easily adjusted. The weight ratio between the anionically derivatized polysaccharide and cationic starch can be also flexibly adjusted, and consequently the charge density of the dry strength composition, for example on basis of any changes in fibre stock properties.

The anionically derivatized polysaccharide and/or the cationic starch for the dry strength composition may be provided as aqueous solutions having elevated solids content. For example, the aqueous solution of the cationic starch may have solids content of 1-25 weight-%, or 6-25 weight-%, or 10-20 weight-%, and/or the aqueous solution of the anionically derivatized polysaccharide may have solids content of 0.1-25 weight-%, or 0.2-5 weight-% or 0.5-3 weight-%. Elevated solids content may be advantageous when the site of use has limited dissolving capacity. Preferably the aqueous solutions of the anionically derivatized polysaccharide and/or the cationic starch are further diluted to a viscosity of less than 1000 mPas, as measured at 25° C. by using Brookfield LV DV1, as defined in the experimental section, to ensure good mixing.

The solids content of the aqueous solution of the dry strength composition may be in the range of 0.2-3 weight-%, preferably 0.5-2 weight-%. This may provide easy mixing of the dry strength composition and avoiding an excess addition of water to the fibre stock. Optionally the dry strength composition may be further diluted before introduction to the fibre stock. Preferably the viscosity of the aqueous solution of the dry strength composition, at the said solids content range, is less than 5000 mPas, preferably less than 1000 mPas, more preferably less than 500 mPas, as measured at 25° C. by using Brookfield LV DV1, as defined in the experimental section, to ensure good mixing to the fibre stock.

Irrespective of the method of dissolving anionically derivatized polysaccharide and cationic starch, they are preferably added to the fibre stock simultaneously. Preferably anionically derivatized polysaccharide and cationic starch are allowed to interact with each other before the dry strength composition is added to the fibre stock in order to enhance the formation of the polyionic complex.

According to one embodiment of the invention, the dry strength composition is in form of an aqueous solution and has preferably a viscosity of <10 000 mPas, preferably <8000 mPas, more preferably <6000 mPas, at solids content of 2 weight-% and at pH 7.0, at 25° C., measured by using Brookfield LV DV1, as defined in the experimental section. Viscosity values indicate that the individual components of the dry strength composition have formed polyion complexes, with enhanced interactions to each other. In this form the dry strength composition is ready for application to the stock, optionally after a further dilution with water.

The dry strength composition may be introduced to thick stock and/or to thin stock. Preferably the composition is introduced at least to the thick stock. Thick stock is here understood as fibre stock having consistency >2 weight-%, preferably >2.5 weight-%. By introducing the dry strength composition to the thick stock i.e. to higher consistency, an improvement in strength effect may be attained, allowing the composition to interact with fibres before dilution of the thick stock with white water that brings fines, fillers, anionic trash, etc., which might otherwise consume the ionic and/or hydrogen bonding capacity of the composition.

The dry strength composition may be applied also on fibre web and/or between wet plies of a multiply construct before joining, for improving various strength characteristics such as z-directional strength, dusting etc, or as an adhesive in the manufacture of corrugated board from fluting and liner. Alternatively, the dry strength composition may be used in sizing emulsions, such as ASA, AKD or rosin emulsions, as stabilizing polymer, and/or for improving retention of internal sizing agent.

According to one embodiment the dry strength composition may be used as a strength agent for providing paper with high humidity strength. High humidity strength encompasses various strength characteristics at relative humidity of 85% or above. Especially the strength composition according to the present invention may be used for improving strength characteristics in terms of improved burst strength, short span compression strength, and/or CMT (Concora medium test) strength of paper, board or the like at high humidity conditions, or at standard 50% relative humidity conditions.

When the dry strength composition according to the present invention is used in the manufacture of paper, board or the like, it is advantageous to add it to fibre stock with a cationic papermaking additive, especially with a cationic coagulant and/or a cationic strength agent.

Any conventional cationic coagulant, including inorganic cationic coagulants, and organic cationic polymers having charge density of at least 3 meq/g (dry), may be used in the method. Examples of inorganic cationic coagulants include alum and polyaluminium chlorides (PAC). Examples of organic cationic polymers having charge density of at least 3 meq/g (dry) include polymers of diallyl dimethyl ammonium chloride (DADMAC), cationic polyacrylamides, cationic polyacrylates, and polyamines, such as polyamidoamines, copolymers of dimethylamine and epichlorohydrin, or copolymers of dimethylamine, epichlorohydrin and ethylenediamine and the like. Typically, the organic cationic polymers used as cationic coagulants have weight-average molecular weight of at most 2 000 000 g/mol, suitably at least 20 000 g/mol, as measured by gel permeation chromatography. Preferably the cationic coagulant is added to the fibre stock before addition of the dry strength composition to enhance the interactions of the dry strength composition with the fibres. Preferably the cationic coagulant is added to thick stock.

When the dry strength composition according to the present invention is used together with a conventional cationic strength agent, the dry strength composition is able form a high number of bonds with the cationic strength agent due to its polyionic nature. The dry strength composition provides a high number of anionic charges capable of interacting with the cationic strength agent, typically cationic strength polymer. This increases the amount and strength of the bonds between the different constituents of the stock, i.e. fibres, fillers, fines, trash, chemicals, etc. The increase in interaction improves the observed dry strength in unexpected degree. Thus, the dry strength composition can interact effectively with the cationic strength agent also under high shear and/or in fibre stock having high cationic demand and/or high conductivity.

The dry strength composition and the cationic strength agent may be added separately to the fibre stock. The dry strength composition may be added before or after, preferably after, the addition of the cationic strength agent. According to one embodiment the cationic strength agent, preferably cationic starch, is added to the fibre stock before introduction of the dry strength composition. When a cationic strength agent is added first to the stock, a risk for strong flocculation at the addition of the dry strength composition may be reduced. Preferably the cationic strength agent is added to the thick stock.

Any conventional cationic strength agent is suitable for use in the present method. For example, the cationic strength agent may be selected from a group comprising cationic starch and synthetic strength polymers, such as polyamidoamine-epichlorohydrin, cationic copolymers of acrylamide and at least a cationic monomer, glyoxylated polymers, and polyvinylamines, as well as any combinations thereof. Polyvinylamines include partially or completely hydrolysed homopolymers of N-vinylformamide, partially or completely hydrolysed copolymers of N-vinylformamide and acrylic acid, as well as partially or completely hydrolysed copolymers of vinylacetate and N-vinylformamide. According to one preferable embodiment the cationic strength agent may comprise or be cationic starch.

The cationic strength agent may be added in amount of 0.5-3 kg/ton dry stock, when a synthetic polymer, such as polyamidoamine-epichlorohydrin, a cationic polymer of acrylamide, or a polyvinylamine, is used as cationic strength agent. The cationic strength agent may be added in amount of 3-20 kg/ton dry stock, preferably 5-18 kg/ton dry stock, more preferably 8-14 kg/ton dry stock, when cationic starch is used as cationic strength agent. All amounts of cationic strength agent are given as dry.

The dry strength composition may be added in amount of 0.5-4.0 kg/ton dry fibre stock, preferably 0.5-3.5 kg/ton dry fibre stock, more preferably 1-3 kg/ton dry fibre stock. All amounts of dry strength composition are given as dry.

It is also possible to add other additives, such as retention aids, to the fibre stock. Preferable retention aids include, for example, anionic and cationic polyacrylamides having a weight-average molecular weight more than 3 000 000 g/mol, and/or inorganic microparticles such as silica, bentonite, etc.

According to one embodiment of the invention the addition of the cationic coagulant and/or cationic strength agent increases original zeta potential value of the fibre stock to a first zeta potential value, which is in the range of −15-+15 mV, preferably −10-+10 mV. According to one embodiment the introduction of the dry strength composition, which comprises at least one anionically derivatized polysaccharide and cationic starch, decreases the obtained first zeta potential value by 1.5-10 mV, preferably by 2-5 mV. For assessing said decrease, the zeta potential is measured immediately before adding the dry strength composition and immediately after its addition.

The dry strength composition according to present invention is suitable for improving dry strength of the fibre web when producing paperboard like liner, fluting, folding boxboard (FBB), white lined chipboard (WLC), solid bleached sulphate (SBS) board, solid unbleached sulphate (SUS) board or liquid packaging board (LPB), but not limited to these. Boards may have grammage from 120 to 500 g/m$^2$.

The dry strength composition according to present invention is suitable for use in improving dry strength of also tissue or fine paper.

The fibre stock may have a pH value at least 4.5, preferably at least 5, more preferably at least 5.5. The stock pH may be in the range of 4.5-9.5, 5-9 preferably 5.5-8.5. The dry strength composition preferably has an anionic net charge at the fibre stock pH. This means that the dry strength composition is able to act as an anionic strength additive capable of ionic interactions with the cationic coagulant, cationic strength agent and other cationic components present in the fibre stock.

According to one embodiment of the invention the dry strength composition is especially used for fibre stock, which comprises recycled fibre pulp and/or high freeness fibres or high bulk fibres, such as chemi-thermomechanical pulp (CTMP) fibres and/or mechanical fibres including thermomechanical pulp (TMP), pressurised groundwood (PGW), alkaline peroxide mechanical pulp (APMP) or stone groundwood (SGW) fibres. All of these may have low strength characteristics, especially low z-directional tensile. The fibre stock may contain at least 30 weight-% (dry), preferably at least 60 weight-%, even 100 weight-% of recycled fibres and/or CTMP. Additionally, the fibre stock may comprise fibres originating from broke.

In addition to dry strength, the dry strength composition may also assist in maintaining or even improving bulk of the paper, board or the like, especially when used in fibre stocks comprising high bulk fibres, and/or when used with conventional bulking agents. Typically, bulk decreases when dry strength is improved. The combination of improved dry strength and maintained or even improved bulk is usually difficult to achieve. However, the dry strength composition of the present invention is usable also when manufacturing paper and board grades requiring both improved dry strength and good bulk properties.

The fibre stock may have a conductivity of at least 1.5 mS/cm or at least 2 mS/cm, preferably at least 3 mS/cm, more preferably at least 4 mS/cm, sometimes even more than 5 mS/cm. According to one embodiment the conductivity of the fibre stock may be in a range of 2-20 mS/cm, preferably 3-20 mS/cm, more preferably 2-15 mS/cm, sometimes even 4-15 mS/cm.

Fibre stock, which may comprise recycled fibre pulp and/or chemical pulp, may have cationic demand of >400 μeq/l.

EXPERIMENTAL

Chemicals and Measurement Methods Used in the Examples

Following methods were used in the examples for analysing the characteristics of aqueous polymer/polysaccharide solutions:

Dry solids content was analysed by using Mettler Toledo HR73, at 150° C.

Viscosity was analysed by using Brookfield LV DV1, equipped with small sample adapter, at 25° C., using spindle S18 for solutions with viscosity <500 mPas and spindle S31 for solutions with viscosity 500 mPas or higher. The highest feasible rotation speed for the spindle was used.

pH of the solution was analysed by using a calibrated pH-meter.

Charge density was determined at pH 7.0 by charge titration, using polyethylene sulfonate solution as titrant and using Mütek PCD-03 for end point detection. pH of the polymer solution was adjusted to pH 7.0 with 10 weight-% aqueous sodium hydroxide solution or with 10 weight-% aqueous sulphuric acid solution before the charge density determination.

Ash content (525° C.) was measured by using standard ISO 1762, 4 h.

Preparation of Polysaccharide Solutions by Using Carboxymethylcellulose, Sodium Salt Products (CMC-Na)

A number of different carboxymethylcellulose, sodium salt products, CMC1-CMC5, were dissolved in water by mixing with a mechanical mixer, 700 rpm, for 3 h at 23° C. Characteristics of the products are given in Table 1.

TABLE 1

Characteristics of CMC-Na products

| CMC-Na product | Ash content, [%] | Dry content [%] | Viscosity [mPas] | pH | Charge density, [meq/g dry] |
|---|---|---|---|---|---|
| CMC1 | 19 | 2.0 | 270 | 6.8 | −3.7 |
| CMC2 | 19 | 2.0 | 640 | 6.4 | −3.9 |
| CMC3 | 19 | 2.0 | 3050 | 6.8 | −3.9 |
| CMC4* | 19 | 1.0 | 360 | 7.0 | −3.9 |
| | | 1.9 | 6360 | 7.0 | −3.9 |
| CMC5 | 28 | 1.9 | 7710 | 6.9 | −1.8 |

*CMC4 viscosity measured at two dry content levels, providing different viscosity values. The pH and charge density remain the same irrespective of the solids content.

Preparation of Cationic Starch, Starch-A 171 g cationic waxy potato starch, Starch-A, dry content 82 weight-%, was suspended in 829 g of water in a reactor equipped with a jacket for heating, a condenser and agitator. Slurry was heated to 98° C. while agitating at 500 rpm. It was kept at that temperature for 45 min with constant agitation on. The formed starch solution, when cooled, had concentration of 14.5 weight-%, pH of 8.3, viscosity of 1200 mPas and charge density (at pH 7.0) of 0.43 meq/g dry material.

Names, compositions and short description of the properties of the chemicals used in the examples are given in Table 2.

TABLE 2

Chemicals used in the examples.

| Name | Composition/Product | Description |
|---|---|---|
| APAM-1 | Copolymer of acrylamide and 8 mol-% acrylic acid, anionic | MW ca. 0.5 Mg/mol |
| Starch-A | Cationic waxy potato starch | charge density 0.4 meq/g; DS 0.07; amylopectin content >95%; cooked |
| Starch | Cationic potato starch | charge density 0.2 meq/g; DS 0.035; amylopectin content 80%; cooked at 97° C. for 30 min, at 1% concentration |
| SCPAM | Copolymer of acrylamide and 10 mol-% ADAM-Cl, cationic | Solution polymer, MW ca. 0.8 Mg/mol |
| CPAM | Copolymer of acrylamide and 10 mol-% ADAM-Cl, cationic | MW 7 000 000 g/mol, dry polymer dissolved at 0.5% concentration |
| CMC1 | CMC-Na, anionic | dissolved at 80° C. for 2 h |
| CMC3 | CMC-Na, anionic | dissolved at 80° C. for 2 h |
| CMC4 | CMC-Na, anionic | dissolved at 80° C. for 2 h |
| CMC5 | CMC-Na, anionic | disintegrated at 80° C. for 2 h |

Preparation of Dry Strength Composition

A series of aqueous dry strength compositions were prepared using the following general procedure.

Dry strength compositions with different proportions of polysaccharide (CMC, Na-salt) and cationic starch (Starch-A), different dry content and different pH value were prepared using dissolved starch solution and dissolved polysaccharide solution, prepared as described above. Dry strength compositions with low dry content were prepared by dilution with de-ionized water.

Dry strength compositions were prepared, and their properties were measured, as given in Table 3. All percentages and values are calculated and given per dry material.

APPLICATION EXAMPLES

Examples 1-8 were performed for providing information about the behaviour and effect of different dry strength compositions. Tables 4 and 5 give methods and standards used for pulp characterisation and sheet testing in the Examples.

TABLE 3

Characteristics of dry strength compositions.

| Dry strength composition | CMC-Na | Starch A [wt-%] | CMC-Na [wt-%] | Dry content [%] | Viscosity [mPas] | pH | Charge density by Mütek at pH 7.0 [meq/g] |
|---|---|---|---|---|---|---|---|
| Comp-A | CMC1 | 50 | 50 | 3.4 | 550 | 7.2 | −1.7 |
| Comp-B | CMC1 | 65 | 35 | 3.4 | 700 | 7.4 | −1.0 |
| Comp-C | CMC4 | 50 | 50 | 1.8 | 680 | 7.2 | −1.7 |
| Comp-D | CMC4 | 65 | 35 | 1.8 | 490 | 7.3 | −1.1 |
| Comp-E | CMC2 | 58 | 42 | 4.0 | 3100 | 6.8 | −1.4 |
| Comp-F | CMC3 | 58 | 42 | 2.9 | 2890 | 7.2 | −1.4 |
| Comp-G | CMC3 | 65 | 35 | 4.6 | 16620 | 7.2 | −1.1 |
| Comp-H | CMC4 | 58 | 42 | 1.6 | 480 | 7.3 | −1.3 |
| Comp-I | CMC5 | 60 | 40 | 4.0 | high viscosity | 7.2 | not determined |
| Comp-J | CMC5 | 50 | 50 | 3.4 | 26000 | 7.2 | −0.7 |
| Comp-K | CMC5 | 40 | 60 | 3.0 | 12600 | 7.0 | −0.9 |

TABLE 4

Pulp characterization methods.

| Property | Device/Standard |
|---|---|
| pH | Knick Portamess 911 |
| Turbidity (NTU) | WTW Turb 555IR |
| Conductivity (mS/cm) | Knick Portamess 911 |
| Charge (μeq/l) | Mütek PCD 03 |
| Zeta potential (mV) | Mütek SZP-06 |
| Consistency (g/l) | ISO 4119 |

TABLE 5

Sheet testing devices and standard methods used for produced paper sheets.

| Measurement | Device | Standard |
|---|---|---|
| Basis weight | Mettler Toledo | ISO 536 |
| Ash content, 525° C. | — | ISO 1762 |
| Scott bond | Huygen | Tappi T 569 |
| Z-directional tensile (ZDT) | Lorentzen & Wettre | ISO 15754 |
| Taber, bending stiffness | Lorentzen & Wettre | Tappi T 489 om-08 |
| Tensile strength, elastic modulus | Lorentzen & Wettre | ISO 1924-3 |
| Bulk | Lorentzen & Wettre | ISO 534 |

TABLE 5-continued

Sheet testing devices and standard methods used for produced paper sheets.

| Measurement | Device | Standard |
|---|---|---|
| Short span compression test (SCT) | Lorentzen & Wettre | ISO 9895 |

Example 1

Example 1 simulates preparation of tissue paper, fine paper, kraft paper or surface layer for multi-ply board.

Test fibre stock was chemical hardwood pulp, which was bleached birch kraft pulp refined at 2% consistency to 25° Shopper Riegler (° SR) in Valley Hollander. Pulp was diluted with deionized water, which conductivity was adjusted to 1.5 mS/cm level by addition of NaCl.

In handsheet preparation the used chemicals were added to the test fibre stock in a dynamic drainage jar (DDJ) under mixing, 1000 rpm. Cationic strength chemicals were diluted before dosing to 0.2 weight-% concentration. Anionic strength chemicals and retention chemical were diluted to 0.05 weight-% concentration before dosing. The used strength chemicals and their addition times are given in Table 6. In addition to the strength chemicals the retention chemical, CPAM (see Table 2), was dosed at dosage of 0.03 kg/t 10 s prior to sheet making. All chemical amounts are given as kg dry active chemical per ton dry fibre stock.

Handsheets having basis weight of 80 g/m$^2$ were formed by using Rapid Kothen sheet former with 1.5 mS/cm conductivity in backwater, adjusted with NaCl, in accordance with ISO 5269-2:2012. The handsheets were dried in vacuum dryers for 6 minutes at 92° C., at 1000 mbar. Before testing the handsheets were pre-conditioned for 24 h at 23° C. in 50% relative humidity, according to ISO 187.

Results for Example 1 are also presented in Table 6. It is seen that dry strength compositions Comp-A, Comp-B and Comp-C are providing improved tensile index and elastic modulus values in comparison to results achieved in reference Test 2 using only starch as cationic strength agent. Needed CMC addition for same strength result is less with the new anionic composition according to the invention compared to CMC alone used in test 8. Excess amount of CMC may not retain to the sheet and can therefore cause additional cationic demand in the water circulation. This risk may be minimised with the present invention. Furthermore, an elastic modulus improvement may be accomplished, which is important in order to achieve good bending stiffness for multi-ply board.

TABLE 6

Hand sheet tests of Example 1: chemical additions and measured results.

| Time [s] Test | −60 Starch | −30 Comp-A | −30 Comp-B | −30 Comp-C | −30 CMC1 | Elastic modulus [Gpa] | Tensile index | Bulk [cm³/g] |
|---|---|---|---|---|---|---|---|---|
| 1 (ref.) | — | — | — | — | — | 5.7 | 55 | 1.38 |
| 2 (ref.) | 15 | — | — | — | — | 5.9 | 75 | 1.35 |
| 3 | 15 | 0.6 | — | — | — | 6.1 | 81 | 1.35 |
| 4 | 15 | 1.2 | — | — | — | 6.2 | 82 | 1.33 |
| 5 | 15 | 2.4 | — | — | — | 6.3 | 84 | 1.33 |
| 6 | 15 | — | 2.4 | — | — | 6.3 | 86 | 1.34 |
| 7 | 15 | — | — | 2.4 | — | 6.4 | 85 | 1.33 |
| 8 (ref.) | 15 | — | — | — | 1.2 | 6.2 | 81 | 1.33 |

Example 2

This example simulates preparation middle ply of multi-ply board, such as folding box board or liquid packaging board. Test sheets were made with Formette-dynamic hand sheet former manufactured by Techpap.

Test fibre stock was made from 80% of bleached dried CTMP having Canadian standard Freeness (CSF) of 580 ml and from 20% of dry base paper broke from manufacture of folding box board. Test pulp was disintegrated according to ISO 5263:1995, at 80° C. Test fibre stock was diluted to 0.6% consistency with deionized water, pH was adjusted to 7, and NaCl salt was added to obtain conductivity of 1.5 mS/cm.

Pulp mixture was added to Formette. Chemical additions were made to mixing tank of Formette according to Table 7. All chemical amounts are given as kg dry chemical per ton dry fibre stock. Water was drained out after all the pulp was sprayed. Drum was operated with 1400 rpm, mixer for pulp 400 rpm, pulp pump 1100 rpm/min, number of sweeps 100 and scoop time was 60 s. Sheet was removed from drum between wire and 1 blotting paper on the other side of the sheet. Wetted blotting paper and wire were removed. Sheets were wet pressed at Techpap nip press with 5 bar pressure with 2 passes having new blotting paper each side of the sheet before each pass. Dry content was determined from the pressed sheet by weighting part of the sheet and drying the part in oven for 4 hours at 110° C. Sheets were dried in restrained condition in drum dryer. Drum temperature was adjusted to 92° C. and passing time to 1 min. Two passes were made. First pass with between blotting papers and second pass without. Before testing in the laboratory sheets were pre-conditioned for 24 h at 23° C. in 50 relative humidity, according to ISO 187.

Table 7 presents the test program and handsheet results. Z-directional tensile for Tests 2-4 and 2-5 show that the results were improved with the addition of dry strength compositions Comp-G and Comp-H compared to the addition of cationic starch alone, even at high dosages (Tests 2-2, 2-3). Elastic modulus was also improved in MD and CD direction when dry strength compositions according to the invention were used. Bulk was not reduced compared to Test 2-1. In general, a common challenge in production of multi-plyboard is to improve z-directional strength without losing bulk significantly. It seems that this problem can be effectively solved with the dry strength compositions according to the invention comprising anionically derivatized polysaccharide and cationic starch.

TABLE 7

Dynamic hand sheet test program and results.

| Time [s] Test | −60 Starch | −30 Comp-G | −30 Comp-H | pressing dryness [%] | ZDT [kPa] | E-mod CD [Gpa] | E-mod MD [Gpa] | bulk [cm³/g] |
|---|---|---|---|---|---|---|---|---|
| 2-1 (ref.) | — | — | — | 37 | 146 | 0.22 | 2.3 | 3.2 |
| 2-2 (ref.) | 5 | — | — | 39 | 186 | 0.22 | 2.3 | 3.3 |
| 2-3 (ref.) | 15 | — | — | 35 | 225 | 0.23 | 2.4 | 3.4 |
| 2-4 | 15 | 2.4 | — | 41 | 279 | 0.26 | 2.6 | 3.2 |
| 2-5 | 15 | — | 2.4 | 36 | 279 | 0.26 | 2.5 | 3.3 |

Example 3

This example simulates preparation of middle ply of multi-ply board, such as folding box board or liquid packaging board. Test sheets were made with Rapid Kothen hand sheet former.

Test fibre stock was made from 90% CTMP and 10% hardwood pulp. CTMP was bleached dried CTMP having CSF of 580 ml. CTMP was disintegrated according to ISO 5263:1995, at 80° C. Hardwood (HW) pulp was bleached birch kraft pulp refined at 2% consistency to 25° SR in Valley Hollander. Test fibre stock was diluted to 0.6% consistency with deionized water, pH was adjusted to 7, and NaCl salt was added to obtain conductivity of 1.5 mS/cm.

In handsheet preparation chemicals were added to the test fibre stock in a dynamic drainage jar under mixing with 1000 rpm. Cationic strength chemicals were diluted before dosing to 0.2 weight-% concentration. Anionic strength chemicals and retention chemicals were diluted to 0.05 weight-% concentration before dosing. The strength chemicals added and their addition times are given in Table 8. The retention chemical CPAM (see Table 2) was dosed 0.03 kg/t 10 s prior to sheet making. All chemical amounts are given as kg dry chemical per ton dry fibre stock.

Handsheets having basis weight of 80 g/m² were formed in the same manner as in Example 1.

Results for Example 3 are shown in Table 8. It can be seen that strength compositions Comp-A, Comp-B, Comp-C and Comp-D provide improved Z-directional tensile (ZTD) and Scott bond values in comparison to that what is gained with reference test 3-1, where cationic starch alone was used as cationic strength agent. Compositions Comp-A, Comp-B, Comp-C and Comp-D provided also better Z-directional tensile and Scott bond values than CMC1 alone in Test 3-14 at same dosage level of 2.4 kg/t. In general, bulk of the produced sheets is typically decreasing with increased strength properties when bonds are generated between the fibres. From the results of Table 8 it can be seen, however, that the reduction of bulk remained low, clearly below 5%, when compositions according to the invention were used.

TABLE 8

Handsheet tests of Example 3: chemical additions and measured results.

| Time [s] Test | −60 Starch | −30 Comp-A | −30 Comp-B | −30 Comp-C | −30 Comp-D | −30 CMC1 | Bulk [cm³/g] | ZDT [kPa] | Scott Bond [J/m²] |
|---|---|---|---|---|---|---|---|---|---|
| 3-1 (ref.) | 15 | — | — | — | — | — | 2.19 | 525 | 190 |
| 3-2 | 15 | 1.2 | — | — | — | — | 2.17 | 600 | 224 |
| 3-3 | 15 | 2.4 | — | — | — | — | 2.16 | 638 | 243 |
| 3-4 | 15 | — | 1.2 | — | — | — | 2.18 | 574 | 212 |
| 3-5 | 15 | — | 2.4 | — | — | — | 2.19 | 619 | 240 |
| 3-6 | 15 | — | — | 1.2 | — | — | 2.14 | 633 | 241 |
| 3-10 | 15 | — | — | 2.4 | — | — | 2.15 | 662 | 261 |
| 3-11 | 15 | — | — | — | 1.2 | — | 2.18 | 589 | 236 |
| 3-12 | 15 | — | — | — | 2.4 | — | 2.16 | 668 | 260 |
| 3-14 (ref.) | 15 | — | — | — | — | 2.4 | 2.15 | 608 | 219 |

Example 4

This example simulates preparation of middle ply of multi-ply board, such as folding box board or liquid packaging board. Test sheets were made with Formette-dynamic hand sheet former manufactured by Techpap.

Test fibre stock was made from 80% of bleached dried CTMP having CSF of 580 ml and from 20% of dry base paper broke from manufacture of folding box board. Test pulp was disintegrated according to ISO 5263:1995, at 70° C. Test fibre stock was diluted to 0.6% consistency with deionized water, salt mixture was added to obtain conductivity of 1.5 mS/cm and pH was adjusted to 7 with sulfuric acid. Salt mixture contained 70% calcium acetate, 20% sodium sulphate and 10% sodium bicarbonate.

Pulp mixture was added to Formette. Chemical additions were made to mixing tank of Formette according to Table 9. All chemical amounts are given as kg dry chemical per ton dry fibre stock. Water was drained out after all the pulp was sprayed. Drum was operated with 1000 rpm, mixer for pulp 400 rpm, pulp pump 1100 rpm/min, number of sweeps 29 and scoop time was 60 s. Sheet was removed from drum between wire and 1 blotting paper on the other side of the sheet. Wetted blotting paper and wire were removed. Sheets were wet pressed at Techpap nip press with 9 bar pressure with 2 passes having new blotting paper each side of the sheet before each pass. Dry content was determined from the pressed sheet by weighting part of the sheet and drying the part in oven for 4 hours at 110° C. Sheets were cut to 15 cm*20 cm size. Sheets were dried in restrained condition in STFI restrained dryers for 10 min at 130° C. Before testing in the laboratory sheets were pre-conditioned for 24 h at 23° C. in 50% relative humidity, according to ISO 187. In this example, tensile index was geometric mean value calculated from square root of MD tensile index*CD tensile index.

Results of Example 4 are presented in Table 9.

TABLE 9

Dynamic hand sheet test program and results of Example 4.

| time [s] Test | −60 Starch | −60 Starch-A | −60 SCPAM | −30 APAM-1 | −30 Comp-H | −30 CMC5 | −30 Comp-J | −30 Comp-K | Zeta potential (after cationic), [mV] | Dryness pressing [%] | Tens. index | ZDT [kPa] | Bulk [cm³/g] |
|---|---|---|---|---|---|---|---|---|---|---|---|---|---|
| 4-1 (ref.) | — | — | — | — | — | — | — | — | −13 | 49 | 15 | 105 | 3.0 |
| 4-2 (ref.) | 5 | — | — | — | — | — | — | — | 0 | 47 | 8 | 102 | 3.3 |
| 4-3 (ref.) | 14 | — | — | — | — | — | — | — | 5 | 32 | 19 | 182 | 3.2 |
| 4-4 (ref.) | 14 | — | — | 0.9 | — | — | — | — | 5 | 52 | 18 | 163 | 3.3 |
| 4-5 (ref.) | 14 | — | — | 1.8 | — | — | — | — | 5 | 52 | 18 | 144 | 3.3 |
| 4-6 | 14 | — | — | — | 0.7 | — | — | — | 5 | 45 | 19 | 180 | 3.2 |
| 4-7 | 14 | — | — | — | 1.4 | — | — | — | 5 | 49 | 20 | 176 | 3.2 |
| 4-8 | 14 | — | — | — | 2.4 | — | — | — | 5 | 49 | 24 | 213 | 3.2 |
| 4-9 (ref.) | 14 | — | — | — | — | 0.5 | — | — | 5 | 52 | 11 | 154 | 3.2 |
| 4-10 (ref.) | 14 | — | — | — | — | 1.0 | — | — | 5 | 51 | 11 | 160 | 3.2 |
| 4-11 | 14 | — | — | — | 2.4 | — | — | — | 5 | 49 | 24 | 213 | 3.2 |
| 4-12 | 14 | — | — | — | — | — | 1.4 | — | 5 | 48 | 21 | 185 | 3.2 |
| 4-13 | 14 | — | — | — | — | — | 2.4 | — | 5 | 52 | 22 | 203 | 3.1 |
| 4-14 | 14 | — | — | — | — | — | — | 1.4 | 5 | 49 | 22 | 195 | 3.1 |
| 4-15 | 14 | — | — | — | — | — | — | 2.4 | 5 | 55 | 21 | 180 | 3.3 |
| 4-16 | — | 6.4 | — | — | 0.7 | — | — | — | 11 | 49 | 15 | 112 | 3.4 |
| 4-17 | — | 6.4 | — | — | 1.4 | — | — | — | 11 | 51 | 15 | 112 | 3.4 |
| 4-18 | — | 1.9 | 1.9 | — | 1.4 | — | — | — | 6 | 50 | 15 | 120 | 3.3 |

It can be seen from Table 9 that an increase in starch addition turns zeta-potential of the stock cationic, which may cause reduced dryness after pressing (see tests 4-2, 4-3). Starch addition with strength compositions Comp-H, Comp-J and Comp-K according to the invention improve the z-directional strength in comparison to tests where starch alone was used or where starch together with separate addition of APAM-1 or CMC5 were used.

Compositions according to invention provide also adequate dryness after pressing which is needed for good speed in drying. It is also surprising that a good tensile strength and z-directional tensile values are obtained at bulk levels that are over 3 $cm^3/g$. It is known that at bulk levels over 3 $cm^3/g$ the contact area between the fibres is limited, and lower tensile index values could be normally expected. Anionically derivatized polysaccharide used in the compositions according to the invention, possibly due to its molecular weight, gives a unique strength effect in this respect.

Other cationic strength agents may be also suitable for the system according to invention. Strength results depend also from cationic component of the strength composition, see tests from 4-16 to 4-18. Preferably cationic chemistry changes zeta-potential of the fibre stock to −5 from +10 mV after the addition of the cationic strength agent.

Example 5

This example simulates preparation of testliner and fluting board.

Test fibre stock was OCC (old corrugated containers) made from central European testliner containing 15% ash. OCC was disintegrated according to ISO 5263:1995, at 80° C. Disintegrated OCC was diluted to 0.8% consistency with water containing 520 mg/l calcium from calcium chloride. Conductivity of test fibre stock was adjusted to 4 mS/cm by sodium chloride addition.

In handsheet preparation chemicals were added to the test fibre stock in a dynamic drainage jar under mixing with 1000 rpm. Cationic strength chemicals were diluted before dosing to 0.2% concentration. Anionic chemicals and retention chemicals were diluted to 0.05% concentration before dosing. The strength chemicals added and their addition times are given in Table 10. Retention chemical CPAM (see Table 2) was dosed 0.15 kg/t 10 s prior to sheet making in Test 5-1. In other tests, from 5-2 to 5-13 retention polymer dosage was adjusted to obtain a retention level, which was required to maintain basis weight, when a constant amount of fibre stock was used. All chemical amounts are given as kg dry chemical per ton dry fibre stock.

Handsheets having basis weight of 80 $g/m^2$ were formed in the same manner than in Example 1.

Short span compression test (SCT) index results for Example 5 are presented in Table 10.

TABLE 10

Handsheet tests of Example 5: chemical additions and measured results.

| Time [s]<br>Test | −60<br>Starch | −30<br>Comp-A | −30<br>Comp-B | −30<br>Comp-C | −30<br>Comp-D | −30<br>CMC1 | SCT index<br>[Nm/g] |
|---|---|---|---|---|---|---|---|
| 5-1 (ref.) | — | — | — | — | — | — | 20.4 |
| 5-2 (ref.) | 10 | — | — | — | — | — | 22.2 |
| 5-5 | 10 | 1 | — | — | — | — | 22.4 |
| 5-6 | 10 | 2 | — | — | — | — | 22.7 |
| 5-7 | 10 | — | 1 | — | — | — | 22.3 |
| 5-8 | 10 | — | 2 | — | — | — | 22.9 |
| 5-9 | 10 | — | — | 1 | — | — | 22.3 |
| 5-10 | 10 | — | — | 2 | — | — | 22.7 |
| 5-11 | 10 | — | — | — | 1 | — | 22.7 |
| 5-12 | 10 | — | — | — | 2 | — | 22.8 |
| 5-13 (ref.) | 10 | — | — | — | — | 1 | 21.0 |

From the results in Table 10 it can be seen that use of starch with strength compositions Comp-A, Comp-B, Comp-C and Comp-D give improved SCT strength values compared to use of starch alone (Test 5-2) or to use of separate additions of starch and CMC1 (Test 5-13). It can be seen from results that products having charge more positive than −1 meq/g at pH 7 show improvements in SCT strength. It seems that CMC type in the dry strength composition may preferably have a higher molecular weight for SCT strength.

Example 6

Preparation of Cationic Starch Component, Starch-B 45 g cationic waxy corn starch, Starch-B, dry content 88 weight-%, was sludged in 1955 g of water in a reactor equipped with a jacket for heating, a condenser and agitator. Slurry was heated to 98° C. while agitating by 500 rpm and kept at that temperature for 60 min with agitation on. The formed starch solution, when cooled, had concentration of 2.0 weight-%, pH of 7.1, viscosity of 180 mPas and charge density at pH 7.0 of 0.26 meq/g dry material.

Preparation of Dispersion of Anionically Derivatized Microfibrillar Cellulose (MFC)

Anionically derivatized microfibrillar cellulose was dispersed in water by mixing. The formed MFC dispersion had dry content of 2.0 weight-%, viscosity of 1170 mPas, and charge density at pH 7.0 of −0.20 meq/g dry material.

Preparation of Dry Strength Compositions Comprising Cationic Starch-B and MFC A series of aqueous dry strength compositions were prepared by mixing different proportions of MFC dispersion and Starch-B solution, prepared as defined above. Dry strength compositions were prepared, and their properties were measured, as given in Table 11. All percentages and values are calculated and given per dry material.

TABLE 11

Properties of starch solution, MFC dispersion and dry strength compositions prepared in Example 6.

| Composition | Starch-B [wt-%] | MFC [wt-%] | Dry content [%] | Viscosity [mPas] | pH | Charge density by Mütek at pH 7.0 [meq/g] |
|---|---|---|---|---|---|---|
| Starch-B | 100 | 0 | 2.0 | 180 | | 0.26 |
| Comp-L | 50 | 50 | 2.0 | 870 | 7.4 | 0.03 |
| Comp-M | 20 | 80 | 2.0 | 1800 | 7.4 | −0.11 |
| Comp-N | 10 | 90 | 2.0 | 3520 | 7.5 | −0.15 |
| MFC | 0 | 100 | 2.0 | 1170 | | −0.20 |

Viscosity results show that poly-ion-complex forms between MFC and cationic starch, when the charge density at pH 7.0 is within the range according to the invention. This is evidenced by viscosity values: viscosities of compositions Comp-N and Comp-M are higher compared to viscosity of Starch-B solution alone, or MFC dispersion alone.

Example 7

Test fibre stock was made from 60% of bleached dried CTMP and from 40% of dry base paper broke from manufacture of folding box board. Test fibre stock was disintegrated according to ISO 5263:1995, at 70° C., and had CSF of 540 ml. Test fibre stock was diluted to 0.6% consistency with deionized water, and a salt mixture containing 70% calcium acetate, 20% sodium sulphate and 10% sodium bicarbonate was added to obtain conductivity of 1.5 mS/cm. pH was adjusted to 7 with sulfuric acid.

Dynamic drainage jar, DDJ (Paper Research Materials, Inc., Seattle, Wash.), was equipped with 60M wire screen, which had 210 μm diameter screen holes. Consistency of the furnish is approximately 0.6% and the sample volume was 500 ml in the experiment. Stirring speed was 1000 rpm and stirring was started 60 s before drainage. Used chemicals were added before the drainage, addition times are indicated in Table 12, as negative times. The retention chemical CPAM (see Table 2) was dosed 0.1 kg/t 15 s prior the drainage. Test 7-1 was a 0-test without any chemical addition. All chemical amounts are given as kg dry chemical per ton dry fibre stock.

At the moment of drainage, the stirring was stopped, and filtrate hose was opened. 200 g of the screened material was taken as sample. 100 g of the sample was filtrated through white ribbon filter paper in Bühner funnel equipped with vacuum. Material on filter paper was weighed after drying. 100 g of filtrate was taken.

Filtrate consistency was calculated from weight of material on filter pad divided by feed sample weight (100 g).

Ash content of 525° C. was measured from furnish and from dried filtrate pads. First pass ash retention was calculated by using following formula:

$$\text{Ash Retention}=100\%*(\text{FeedAsh}*\text{FeedCons}-\text{FiltrateAsh}*\text{FiltrateCons})/(\text{FeedAsh}*\text{FeedCons})$$

where

FeedAsh, FiltrateAsh denotes the ash content of the feed and the filtrate, respectively; and FeedCons, FiltrateCons denotes the consistency of the feed and the filtrate, respectively.

Zeta-potential was measured from the feed sample after addition of chemicals. Determination of the charge density was made by filtering 20 ml DDJ filtrate through black ribbon filter paper gravimetrically in a funnel and measuring the charge with Mütek PCD titration.

Determination of soluble starch was made from DDJ filtrate. To a sample of 25 ml filtrate was added to 10 ml of 10 weight-% HCl. Mixture was stirred for 10 min in 50 ml beaker with magnetic stirrer, and then filtrated by gravitation in a funnel with black ribbon filter paper. 5 ml of obtained filtrate from the mixture was taken, and 0.5 ml iodine reagent (7.5 g Kl/l+5 g $I_2$/l), was added. After 2 min reaction time, absorbance value was measured at 610 nm by Hach Lange DR 900 spectrophotometer. Zeroing of the spectrophotometer was done by using the sample before iodine reagent addition. Raisamyl 50021 cationic starch was used as reference to make calibration equation for starch content determination. Test pulp starch content was determined by same method than DDA filtrate starch content. Blank test for HCl-iodine solution absorbance was made to subtract baseline absorbance from the results.

The obtained test results are given in Table 12. Usually a good charge level for a retention system is from −400 to −10 μeq/1, and a good Zeta-potential value is <−2 mV for avoiding foaming and poor retention of cationic starch. Filtrate starch value can be used to indicate the total starch retention, including starch from broke and/or from wet-end starch. Usually a filtrate starch value <50 mg/l is a suitable level for avoiding deposits and slime formation.

Tests 7-3, 7-5, 7-6, 7-11, 7-12 and 7-16 use COMP-H (see Table 3) as dry strength composition. In reference Test 7-7 the dry strength composition comprises CMC4, added in amount of 0.12 kg/t, and Starch-A, added in amount of 2.28 kg/t, resulting a charge density of +0.18 meq/g for the composition at pH 7. In reference Test 7-8 the dry strength composition comprises CMC4, added in amount of 2.28 kg/t, and Starch-A, added in amount of 0.12 kg/t, resulting a charge density of −3.8 meq/g for the composition at pH 7.

TABLE 12

Chemical additions and measured results for Example 7.

| Time [s] Test | −60 Starch-1 [kg/t dry] | −30 Dry Strength Comp. [kg/t dry] | −30 Starch-A [kg/t] | −30 CMC4 [kg/t] | CMC4 in Strength Comp. [kg/t] | Starch-A in Strength Comp. [kg/t] | Charge [μeq/l] | Filtrate Starch [mg/l] | Zeta-potential [mV] | Ash retention [%] |
|---|---|---|---|---|---|---|---|---|---|---|
| 7-1 (ref.) | — | — | — | — | — | — | −16 | 19 | −11.7 | 54 |
| 7-2 (ref.) | — | — | — | — | — | — | −11 | 21 | −12.4 | 58 |
| 7-3 (ref.) | — | 2.4 | — | — | 1.0 | 1.4 | −34 | 20 | −30.3 | 56 |
| 7-4 (ref.) | 12 | — | — | — | — | — | −3 | 59 | 5.9 | 59 |
| 7-5 | 12 | 1.4 | — | — | 0.6 | 0.8 | −14 | 45 | — | 57 |
| 7-6 | 12 | 2.4 | — | — | 1.0 | 1.4 | −17 | 43 | −3.9 | 58 |

TABLE 12-continued

Chemical additions and measured results for Example 7.

| Time [s] Test | −60 Starch-1 [kg/t dry] | −30 Dry Strength Comp. [kg/t dry] | −30 Starch-A [kg/t] | −30 CMC4 [kg/t] | CMC4 in Strength Comp. [kg/t] | Starch-A in Strength Comp. [kg/t] | Charge [μeq/l] | Filtrate Starch [mg/l] | Zeta-potential [mV] | Ash retention [%] |
|---|---|---|---|---|---|---|---|---|---|---|
| 7-7 (ref.) | 12 | 2.4 | — | — | 2.28 | 0.12 | >50 | 66 | 7.2 | 58 |
| 7-8 (ref.) | 12 | 2.4 | — | — | 0.12 | 2.28 | −38 | 42 | −18.7 | 55 |
| 7-9 (ref.) | 12 | — | — | 0.6 | — | — | −12 | 43 | — | 56 |
| 7-10 (ref.) | 12 | — | — | 1.0 | — | — | −16 | 40 | — | 55 |
| 7-11 | 3 | 2.4 | — | — | 1.0 | 1.4 | −25 | 23 | — | — |
| 7-12 | 8 | 2.4 | — | — | 1.0 | 1.4 | −27 | 30 | — | — |
| 7-13 (ref.) | 12 | — | 0.8 | — | — | — | −1 | 57 | — | — |
| 7-14 (ref.) | 12 | — | 1.4 | — | — | — | >50 | 64 | — | — |
| 7-15 (ref.) | 12 | — | 3.5 | — | — | — | >50 | 73 | — | — |
| 7-16 | 12 | 6 | — | — | 2.5 | 3.5 | −29 | 40 | — | — |

It is seen from Table 12 that in Tests 7-3 and 7-4, where only cationic strength agent or dry strength composition are used alone, there may be problems of low ash retention (Test 7-3) or of positive Zeta-potential (Test 7-4).

The Tests 7-5, 7-6 and 7-16 according to the invention show good charge, good filtrate starch content and good ash retention. Variation in cationic strength dosage is seen in Tests 7-11 and 7-12.

Reference Tests 7-7 and 7-8 show that when the dry strength composition comprises anionically derivatized polysaccharide (CMC4) and cationic starch (Starch-A) in amount that produces a charge ratio outside the defined range, the obtained results deteriorate. Test 7-7 is net cationic which generates cationic filtrate charge and too high filtrate starch. Test 7-8 generates low ash retention compared to the dry strength composition according to the invention.

Reference Tests 7-9 and 7-10 show that separate use of cationic strength agent and anionic polysaccharide does not provide desired results. Especially the obtained ash retention is low.

Reference Tests 7-13, 7-14 and 7-15 show results when cationic amylopectin starch (Starch-A) is added without mixing with anionically derivatized polysaccharide. It is seen that t generates too high cationic charge to the filtrate.

Example 8

This example demonstrates drainage and dewatering results obtainable.

Test fibre stock was made from 70% of bleached dried CTMP and from 30% of dry base paper broke from manufacture of folding box board. Test pulp was disintegrated according to ISO 5263:1995, at 70° C., and had a CSF value of 450 ml. Test fibre stock was diluted to 0.8% consistency with deionized water, and a salt mixture containing contained 70% calcium acetate, 20% sodium sulphate and 10% sodium bicarbonate was added to obtain conductivity of 1.5 mS/cm. pH was adjusted to 7 with sulfuric acid.

Dynamic Drainage Analyzer (DDA) Test

A Dynamic Drainage Analyzer, DDA, (AB Akribi Kemikonsulter, Sweden) was used to measure drainage. DDA's vacuum and stirrer were calibrated and necessary adjustments to the settings were made. DDA was connected to a computer for measuring the time between vacuum application and the vacuum break point. A change in the vacuum expresses the drainage time of a wet fibre web until air breaks through the thickening web indicating the drainage time. A drainage time limit was set to 30 seconds for the measurements.

In drainage measurements, 500 ml of the stock sample was measured into the reaction jar. The drainage test was performed by mixing the sample stock with the stirrer at 1000 rpm for 40 s while the chemicals to be tested were added in the predetermined order. Test chemical addition times are indicated in Table 13 as negative times, calculated backwards from the start of the drainage. A wire with 0.25 mm openings was used in the drainage test. 300 mbar vacuum for 30 s after drainage was used. Drainage time was recorded. Filtrate turbidity was measured immediately. Wet sheet was weighted to calculate dry content after forming. Wet pressing of the sheets was completed individually immediately after drainage test in Lorenz & Wettre wet press for 1 min at 4 bar pressure, 2 blotting papers both sides of the sheet. Pressed sheet was weighted. The sheet was reweighted after 5 min drying in Lorenz & Wettre hot plate dryer to calculate dry content after pressing. Relative retention was calculated from dry weight of the sheet compared to dry weight of the 0-test (Test 8-1) sheet.

Comp-Ref was used as a reference composition. Comp-Ref is made by mixing cationic amylopectin starch and anionic polyacrylamide at 50:50 weight ratio, and corresponds to conventional polyelectrolyte complexes used in paper and board making. Charge of COMP-Ref was +0.2 meq/g at pH 2.7 and −0.6 at pH 7. Used silica was colloidal silica having about 5 nm particle size.

Chemical additions, dosing times and the measured results are given in Table 13.

It is seen from Table 13 that the filtrate turbidity is improved when dry strength composition Comp-H is used (see Tests 8-3, 8-4, 8-5) in comparison to reference Tests 8-1 and 8-2. In comparison to results obtained with Comp-Ref in Tests 8-11, 8-12 the dry strength composition according to invention outperforms in both drainage time, forming dryness as well as in press dewatering.

Furthermore, results for Tests 8-4 and 8-5 show improvement in dryness after forming and in relative retention. It can also be seen that the dry strength composition in general provides improved dryness after forming as well as pressing and also an improved relative retention (Test 8-6, 8-7, 8-8).

The dry strength composition according to the present invention works well with conventional retention systems also, which make the composition suitable for a variety of different chemical systems used in paper and board making. In is seen from Table 13 that the dry strength composition can be combined with conventional retention system comprising CPAM and silica, and a good drainage and retention performance can be obtained (Tests 8-9, 8-10).

TABLE 13

Chemical additions, dosing times and results for Example 8.

| Time [s] Test | −60 Starch [kg/t dry] | −30 Comp-H [kg/t dry] | −30 Comp-Ref [kg/t dry] | −15 CPAM [kg/t dry] | −10 Silica [kg/t dry] | Drainage time, [s] | Turbidity, NTU | Dryness after forming, [%] | Dryness after pressing, [%] | Relative retention, [%] |
|---|---|---|---|---|---|---|---|---|---|---|
| 8-1 (ref.) | — | — | — | — | — | — | 124 | 21 | 50 | 100 |
| 8-2 (ref.) | 12 | — | — | — | — | 9 | 115 | 21 | 51 | 100 |
| 8-3 | 12 | 1.6 | — | — | — | 9 | 114 | 21 | 51 | 102 |
| 8-4 | 12 | 2.4 | — | — | — | 9 | 103 | 22 | 51 | 103 |
| 8-5 | 12 | 4 | — | — | — | 9 | 98 | 22 | 52 | 102 |
| 8-6 | — | 1.6 | — | — | — | 7 | — | 24 | 57 | 111 |
| 8-7 | — | 2.4 | — | — | — | 7 | — | 23 | 52 | 106 |
| 8-8 | — | 4 | — | — | — | 7 | — | 23 | 53 | 108 |
| 8-9 | 12 | 0.8 | — | 0.15 | 0.3 | 8 | — | 22 | 55 | 107 |
| 8-10 | 12 | 1.6 | — | 0.15 | 0.3 | 8 | — | 22 | 52 | 108 |
| 8-11 (ref.) | 12 | — | 1.6 | — | — | 9 | — | 20 | 50 | 101 |
| 8-12 (ref.) | 12 | — | 2.4 | — | — | 9 | — | 21 | 49 | 102 |

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

The invention claimed is:

1. A dry strength composition for manufacture of paper, board, which comprises, as a mixture:

at least one anionically derivatized polysaccharide, comprising carboxymethylated cellulose having a viscosity in a range of 100-30 000 mPas, measured from a 2 weight-% aqueous solution at 25° C., by using a Brookfield LV DV1, and cationic starch having an amylopectin content ≥80 weight-%, wherein the anionically derivatized polysaccharide and the cationic starch provide the composition with a charge density in a range of:

0.1-1.5 meq/g, when measured at pH 2.8, and 0.1-3 meq/g, when measured as an aqueous solution, at pH 7.0.

2. The dry strength composition according to claim 1, wherein the anionically derivatized polysaccharide comprises carboxymethylated cellulose having a degree of carboxymethyl substitution >0.2, and/or a charge density value <−1.1 meq/g, when measured at pH 7, and/or viscosity in a range of 200-20 000 mPas measured from a 2 weight-% aqueous solution at 25° C., by using a Brookfield LV DV1, and/or ash content <35 weight-% of dry material, at 525° C., 4 h.

3. The dry strength composition according to claim 1, wherein the cationic starch has:

an amylopectin content ≥85 weight-%, and/or a substitution degree of 0.025-0.3.

4. The dry strength composition according to claim 1, wherein the dry strength composition comprises the anionically derivatized polysaccharide and the cationic starch in a weight ratio (dry/dry) of 10:90-90:10.

5. The dry strength composition according to claim 1, wherein the dry strength composition is in form of a dry particulate material.

6. The dry strength composition according to claim 1, wherein the dry strength composition is in form of an aqueous solution, having a viscosity of <10 000 mPas, at solids content of 2 weight-% and at pH 7.0, at 25° C., measured by using a Brookfield LV DV1.

* * * * *